US005954199A

United States Patent [19]

Stratton

[11] Patent Number: 5,954,199

[45] Date of Patent: Sep. 21, 1999

[54] GOLF BAG WITH CLUB SEPARATOR

[76] Inventor: Harry A. Stratton, 1440 Hillvale Rd., Louisville, Tenn. 37777

[21] Appl. No.: 08/791,133

[22] Filed: Jan. 30, 1997

[51] Int. Cl.[6] ..... A63B 55/04

[52] U.S. Cl. ..... 206/315.6; 206/315.4

[58] Field of Search ..... 206/315.3, 315.4, 206/315.5, 315.6, 315.8

[56] References Cited

U.S. PATENT DOCUMENTS

| | | | |
|---|---|---|---|
| 1,809,536 | 6/1931 | Tucker | 206/315.6 X |
| 3,554,255 | 1/1971 | Mangan | 150/1.5 |
| 4,055,207 | 10/1977 | Goodwin | 150/1.5 R |
| 4,200,131 | 4/1980 | Chitwood et al. | 150/1.5 R |
| 4,332,283 | 6/1982 | Rader | 206/315.6 |
| 4,383,563 | 5/1983 | Kirchhoff, Jr. | 206/315.3 X |
| 4,911,465 | 3/1990 | Hauer | 280/646 |
| 4,995,510 | 2/1991 | Fletcher, Jr. | 206/315.6 |
| 5,071,147 | 12/1991 | Stansbury | 206/315.6 X |
| 5,458,240 | 10/1995 | Rich et al. | 206/315.3 |
| 5,607,053 | 3/1997 | Sumiyoshi | 206/315.3 X |

FOREIGN PATENT DOCUMENTS

| | | | |
|---|---|---|---|
| 214555 | 8/1967 | Sweden | 206/315.5 |

*Primary Examiner*—Jes F. Pascua
*Assistant Examiner*—Tri M. Mai
*Attorney, Agent, or Firm*—Pitts & Brittian, P.C.

[57] ABSTRACT

An Improved Golf Bag with Club Separator (10) for separating and protecting golf club irons carried within a golf bag from damaging contact with other club irons in the bag when that bag is being transported. The Improved Golf Bag with Club Separator (10) includes an upper end (12) defining an opening (14), a club head support (16) received in the upper end (12) of the golf bag (10), and a lower end (18) defining a closure (20). The lower end (18) is disposed opposite the upper end (12) at a distance whereby the entire length of each golf club iron received within the bag (10) and each iron head is received in the club head support (16) without the shaft end of the golf club contacting said lower end (18) of said golf bag (10). The club head support (16) defines a plurality of tiers (22) which are staggered in a step-wise fashion. The uppermost and lowermost tiers (26, 30) each include at least golf club one opening (34). Each intermediate tier (32) is divided by a partition (38) which, with the vertical walls (44) created by adjoining tiers (46), and the horizontal surface (48) separating the adjoining tiers (46), forms individual club head compartments (40) for receiving the head of each golf club iron disposed within each golf club opening (34).

9 Claims, 8 Drawing Sheets

GOLF BAG WITH CLUB SEPARATOR

TECHNICAL FIELD

This invention relates to the field of sporting goods and sporting good accessories. More specifically, this invention relates to the sport of golf and golfing accessories which facilitate the playing of golf, such as a golf bag.

BACKGROUND ART

In the field of golf, it is well-known that golf bags are utilized to carry golf clubs and to keep those golf clubs organized while they are used and transported on the golf course during a round of golf.

Traditionally, golf clubs were carried in golf bags that were carried about a golf course either by the golfers themselves or by their caddies. The predominance of golf bags in the art today are fabricated in contemplation of these methods of carriage. Such bags are typically constructed to include an oval or rounded tubular golf club compartment as well as a number of externally disposed pockets or other smaller compartments for carrying golf related items such as golf tees, golf balls, scorecards, and pencils for completing score cards. Depending on the quality and cost of the particular golf bag, the golf club compartment is constructed of a unitary ovoid or circular piece of plastic and includes a club divider on its open end, an encapsulating nylon shell which contains the smaller storage compartments, and a stand which extends outward from a side of the bag to assist in positioning the bag to remain standing while one of the clubs from the bag is in use. Alternatively, the bag is constructed to include a multi-sectional golf club compartment which is divided into a number of lined cavities that extend the length of the golf bag and enable the separate grouping of the golf clubs, a sewn shell surrounding the club compartment for storing golf accessories, including a golf umbrella, a ball retriever, a rain suit, and even a pair of golfer's shoes.

As is commonly known today, the predominance of golfers today rely on golf carts to transport their golf bags while they play a round of golf. In using golf carts, golfers are typically required to secure their bags onto golf cart carry stands which are typically located on the rear of the golf cart. This is usually accomplished by positioning their golf bag such that a security strap can be inserted through the carry handle on their bag and to a securement device. Unfortunately for the golfer, however, the positioning of their bag in this respect typically results in disposing the longer clubs of their bag, their woods, closer to them while their shorter clubs, their irons, are farther removed and located behind the woods. This positioning causes great inconvenience to the golfers as such positioning makes it difficult for the golfer to see and/or reach around the woods and longer irons to find the short iron that they need for a shot. Moreover, having to position their golf bag on the golf cart in this fashion compels the golfer to have to then reach or maneuver around those longer clubs in their bag to reach the clubs that are more commonly used on the fairways. Placing their golf bag in this position also inconveniences the golfers in that the golf ball pouch on their bag is positioned away from them, between the golf bag and the rear of the golf cart, while their garment pouch is facing them.

The predominance of golf bags in the art are also ill-fabricated or otherwise ill-suited to carry a golfer's clubs in such a way as to minimize or prevent the inadvertent contact of the heads of the golf club irons, regardless of whether the golf bag is carried by hand or by golf cart. The construction of such bags, thus, results in damage to the heads of the golf club irons as a result of the head-to-head contact. Even in those golf bags where the bag design is somewhat successful in avoiding damage to iron club heads, golf bags in the art are ill-suited to the convenience of the golfer as they, too, dispose of the golf club irons in a manner which is inconvenient for the golfer to reach the club iron of choice, return a used club iron to the proper receptacle. Moreover, none of the golf bags in the art provide that the bag is equally useful to the golfer regardless of their "handedness".

Other devices have been produced to carry golf clubs and golf related items for golfers while golfing. Typical of the art are those devices disclosed in the following U.S. Patents:

| U.S. Pat. No. | Inventor(s) | Issue Date |
|---|---|---|
| 3,554,255 | J. P. Mangan | Jan. 12, 1971 |
| 4,055,207 | J. E. Goodwin | Oct. 25, 1977 |
| 4,200,131 | E. L. Chitwood, et al. | Apr. 29, 1980 |
| 4,911,465 | H. J. Hauer | Mar. 27, 1990 |
| 4,995,510 | C. C. Fletcher, Jr. | Feb. 26, 1991 |
| 5,458,240 | P. R. Rich, et al. | Oct. 17, 1995 |

The '255 patent issued to Mangan discloses an adapter for sorting golf clubs which is insertable into the open end of golf bags that lack any integrally molded, apertured closure member. The Mangan device is seated on the ribs that are typically transversely provided on golf bags. The Mangan device has a planar configuration and permits the separation of club shafts from each other within the bag cavity by inclusion of a plurality of parallel-disposed tubes which insert into each of the openings of the adapter.

The '207 patent issued to Goodwin discloses an insertable, molded, one-piece retainer head which is received in the open end of a golf bag. The retainer includes three downwardly and forwardly pitched tiers having individual ribs which releasably secure the heads of golf club irons. The shafts of irons are received in passageways which are disposed proximate each rib and which extend downwardly at right angles from each stepped level. Woods in the Goodwin device are received, one each, in equally spaced passageways which are disposed on the uppermost tier level in a semicircular arrangement.

The '131 patent issued to Chitwood, et al., discloses a golf bag construction in which the top surface includes recessed openings for receiving the heads of each of golf club of a set of clubs wherein each opening is angled to correspond with the loft angle of a particular golf club iron. The Chitwood bag includes an upper plate and a lower plate connected by a series of tubes for receiving the shafts of golf clubs. The apertures for receiving the irons are disposed in two evenly spaced rows. The apertures for receiving the woods in the Chitwood bag are spaced at a distance far enough apart to avoid contact with the irons and/or the other wood heads.

The '465 patent issued to Hauer discloses a golf bag having a retractable wheel assembly and elongated tubes for receiving club shafts wherein the tubes include a resiliently deformable material for frictionally engaging and securing the club in a stable position while in the golf bag. The iron and wood tubes are received in three linearly arranged rows which are disposed on a planar surface and which permit the club heads to extend above that surface from each of their respective tubes.

The '510 patent to Fletcher, Jr. discloses a club separating insert system for a golf bag which permits the grouping of clubs at spaced intervals and a process for designing such systems for golf bags. The Fletcher system utilizes the difference in the length of the clubs as well as the range of rotational movement and size of the club heads in specifically disposing each iron and wood in particular positions within the golf bag.

The '240 patent to Rich, et al., discloses a golf bag which includes an upper club head support having a plurality of pockets and a plurality of corresponding shaft receiving holes for receiving a plurality of golf club heads and the shafts corresponding to each club head. The Rich golf bag further includes a lower base section which is disposed in a spaced relation to the upper club head support and a bag forming material section extending between the upper club head support and the lower base section. Each pocket of the upper club head section in the Rich golf bag is formed to protect each club head from contact with any other club head.

Of the foregoing devices, the '255 patent issued to Mangan, the '465 patent issued to Hauer, and the '510 patent issued to Fletcher disclose golf bags which fail to adequately protect against club head damage resulting from inadvertent club head contact. The Mangan and Hauer golf bags both provide for disposing each club in an individual club receptacle. However, neither golf bag provides sufficient distance or separation between each head of each club in the golf bag to minimize or eliminate the potential for club head damage. Such damage can result in either or both of the Mangan and Hauer golf bags by the rotation of the club heads in the golf bag upon movement of the bag or upon re-insertion of a golf club into a tube after use. The Fletcher golf bag attempts to solve this problem by providing for the separation of the golf club heads on the basis of height. However, the Fletcher bag similarly fails in its objective, especially as is evidenced by the interactions of adjacently disposed, similar length clubs. Clearly, longer shafted woods and irons are disposable so as to avoid contact with shorter shafted clubs. Where those clubs are of close proximity in weight and shaft length, however, contact between these clubs is unavoidable. The contact which can result is from either or both club movement in carrying or positioning the golf bag or in replacement of the club in the golf bag after use. Such conclusions are equally unavoidable regardless of which Fletcher design process and/or configuration is utilized.

Like the Mangan device, the retainer disclosed in the '207 patent to Goodwin includes a plurality of shaft-receiving passageways which are correspondingly disposed at right angles to the openings of the retainer head. The Goodwin device, however, is limited in its applicability by its construction. While golfers are either right or left-handed, the Goodwin device is clearly configured to adapt to one golfer's particular handedness and is not useable by a golfer of a different handedness. The angling of the openings for receiving the club heads clearly defines this limitation. Moreover, while securing a golfer's irons from inadvertent contact between rows of clubs, the Goodwin device fails to make similar provision for the golfer's irons within the same club row. The potential for club head intercontact and damage is also evidenced by the fact that the golf bags in which it is foreseen that the Goodwin device will be used are bags in which the club shaft length approximates the length of the golf bag. This bag length limitation enhances the risk of inadvertent club dislodging and contact as the clubs may be easily jostled out of their slots.

The devices disclosed in the '131 patent to Chitwood, et al., and the '240 patent issued to Rich, et al., include similar limitations. The Chitwood device does disclose a club holder arrangement which completely protects the heads of irons from inadvertent contact. However, this device includes the identical club head angulation and handedness limitations described regarding the Goodwin device. Moreover, the disposal of the iron club heads within spaces that enclose all but lower edge renders each club inconvenient, if not difficult, to remove from the Chitwood club divider. The Chitwood divider is also limited in its application given the continued evolution of golf club styles as that evolution in club style is bringing different angles of club face to each club in a golfers bag. Consequently, the design of a club head receptacle has severely limited the value of the Chitwood bag.

The Rich device includes the identical club head angulation and handedness limitations described for the woods as well as the irons of the golf set. The planar surface within each divider of the rich device fails to adequately seat each club head so that jostling or movement of the golf bag will not result in displacement of the clubs from their divider and contact between them. Moreover, the disposal of a club head in a divider whose lower surface is inclined parallel with the incline of the head support is not only impractical, it heightens the likelihood that the club head disposed in that divider will dislodge easily, and contact club heads of adjacent clubs.

Therefore, it is an object of this invention to provide a golf bag with a club separator which provides an improved means for securing iron club heads in a stable position to minimize or eliminate iron club head damage due to collision with other iron club heads.

It is also an object of this invention to provide an improved golf bag with a club separator which improves the security iron club heads within a golf club head compartment by providing that the lowermost end of the golf club shaft does not contact the lowermost surface of the golf bag when the club head is resting in the club head compartment.

It is another object of this invention to provide a golf bag with length and overall configuration designed to further stabilize iron club heads in their respective dividers and thereby avoid club damage.

Further, it is an object of this invention to provide an improved golf bag with a club separator which recognizes and accounts for the changes in the game today where golfers predominantly use golf carts, and not caddies, to carry golf bags.

It is also an object of this invention to provide an improved golf bag with a club separator where the short irons are always in front when the bag is mounted to a golf cart.

It is another object of this invention to provide an improved golf bag with a club separator where the bag is useable to golfers regardless of their handedness.

Moreover, it is an object of the present invention to provide an improved golf bag with a club separator which is more organized and out of which it is easier to play.

DISCLOSURE OF THE INVENTION

Other objects and advantages will be accomplished by the present invention which serves to separate and protect golf club irons carried within a golf bag from damaging contact with other club irons in the bag when that bag is being transported.

The Improved Golf Bag with Club Separator includes an upper end defining an opening, a club head support received in the opening defined by the upper end of the golf bag, and a lower end defining a closure. The lower end of the Improved Golf Bag with Club Separator is disposed opposite the upper end of the golf bag at a distance whereby the entire length of each golf club iron positioned in the bag is received within the bag and each head of each golf club iron is received in the club head support without the shaft end of the golf club touching the lower end of the golf bag.

The club head support defines a plurality of tiers. Each tier is staggered from the next in a step-wise fashion such that the first tier defines an uppermost tier and the last tier defines a lowermost tier. The plurality of tiers between the uppermost and lowermost tiers are intermediate tiers. Each of the uppermost and lowermost tiers of the club head support includes at least one opening for receiving at least one golf club.

Each of the intermediate tiers of the club head support is divided by a partition disposed between the uppermost and lowermost tiers. The partition is disposed within each of the intermediate tiers such that individual club head compartments are formed within each tier. The wall formed by the partition, along with the vertical walls created by ajoining tiers and the horizontal surface separating the adjoining tiers function to create an individual club head compartment for each golf club iron received within at least one opening for receiving a golf club which is positioned on each tier's horizontal surface.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
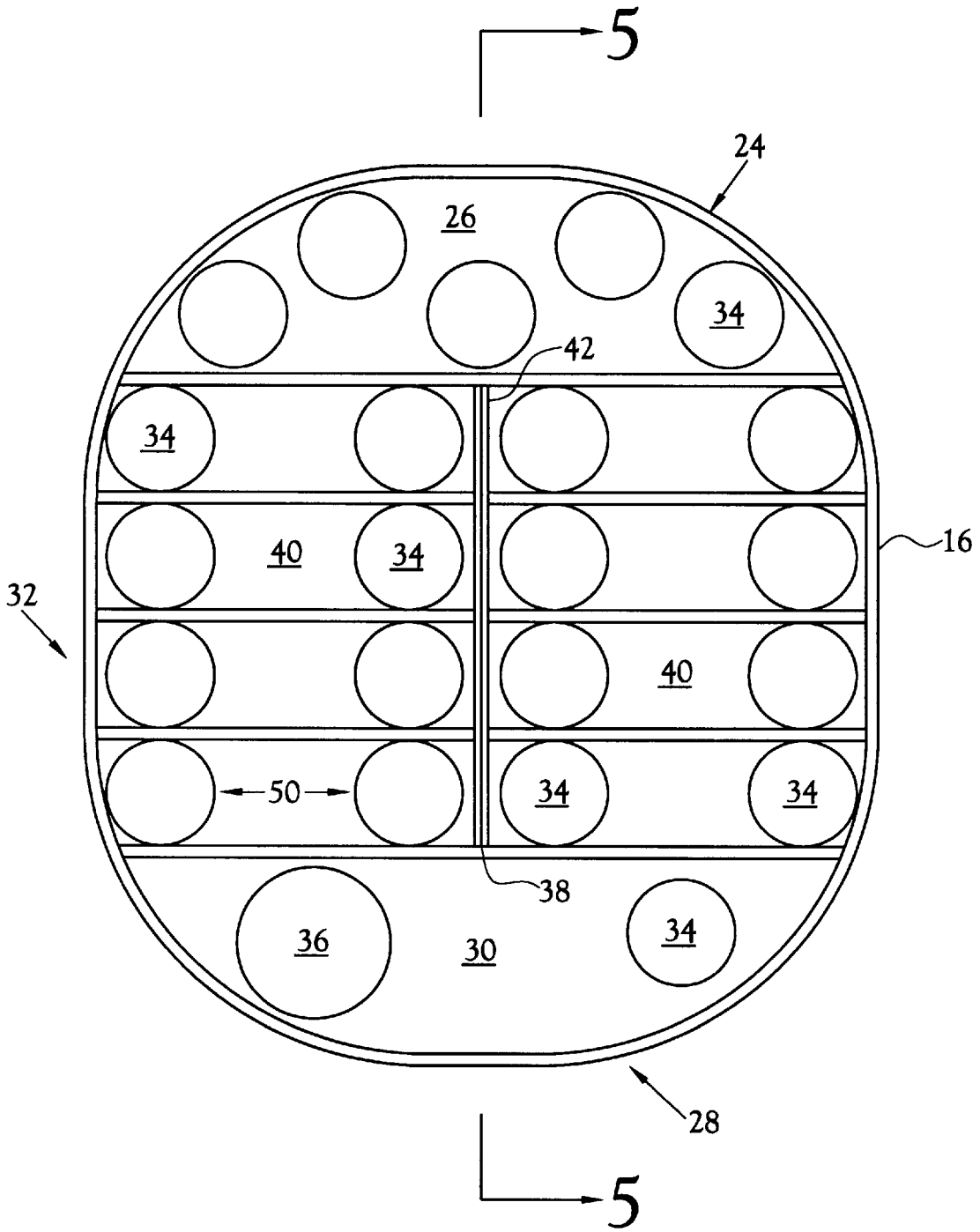
FIG. 1 is a top plan view of the Improved Golf Bag with Club Separator constructed in accordance with several features of the present invention.

A Improved Golf Bag with Club Separator incorporating various features of the present invention is illustrated generally at 10 in the figures. The Improved Golf Bag with Club Separator 10, is designed for carrying golf clubs and protecting each golf club iron from damaging contact with other irons in the golf bag 10 when the bag 10 is being transported. Moreover, in the preferred embodiment the Improved Golf Bag with Club Separator 10 is designed to position golf clubs within the golf bag 10 such that they are easily accessible to the golfer when the golf bag 10 is mounted on a conventional golf cart.

The Improved Golf Bag with Club Separator 10 includes an upper end 12 defining an opening 14, a club head support 16 received in the opening 14 defined by the upper end 12 of the golf bag 10, and a lower end 18 defining a closure 20. The lower end 18 of the Improved Golf Bag with Club Separator 10 is disposed opposite the upper end 12 at a distance whereby the entire length of each golf club iron positioned in the bag 10 is received within the bag 10 and each head of each club iron is received in the club head support 16 without the shaft end of the golf club touching the lower end 18 of the golf bag 10. In the preferred embodiment, the distance separating the club head support 16 and the lower end 18 of the Improved Golf Bag with Club Separator 10 is the length of a 3-iron golf club plus one inch. The distance between the club head support 16 and the lower end 18 of the improved golf bag with Club Separator 10 of the preferred embodiment is 39 inches.

Figure 2:
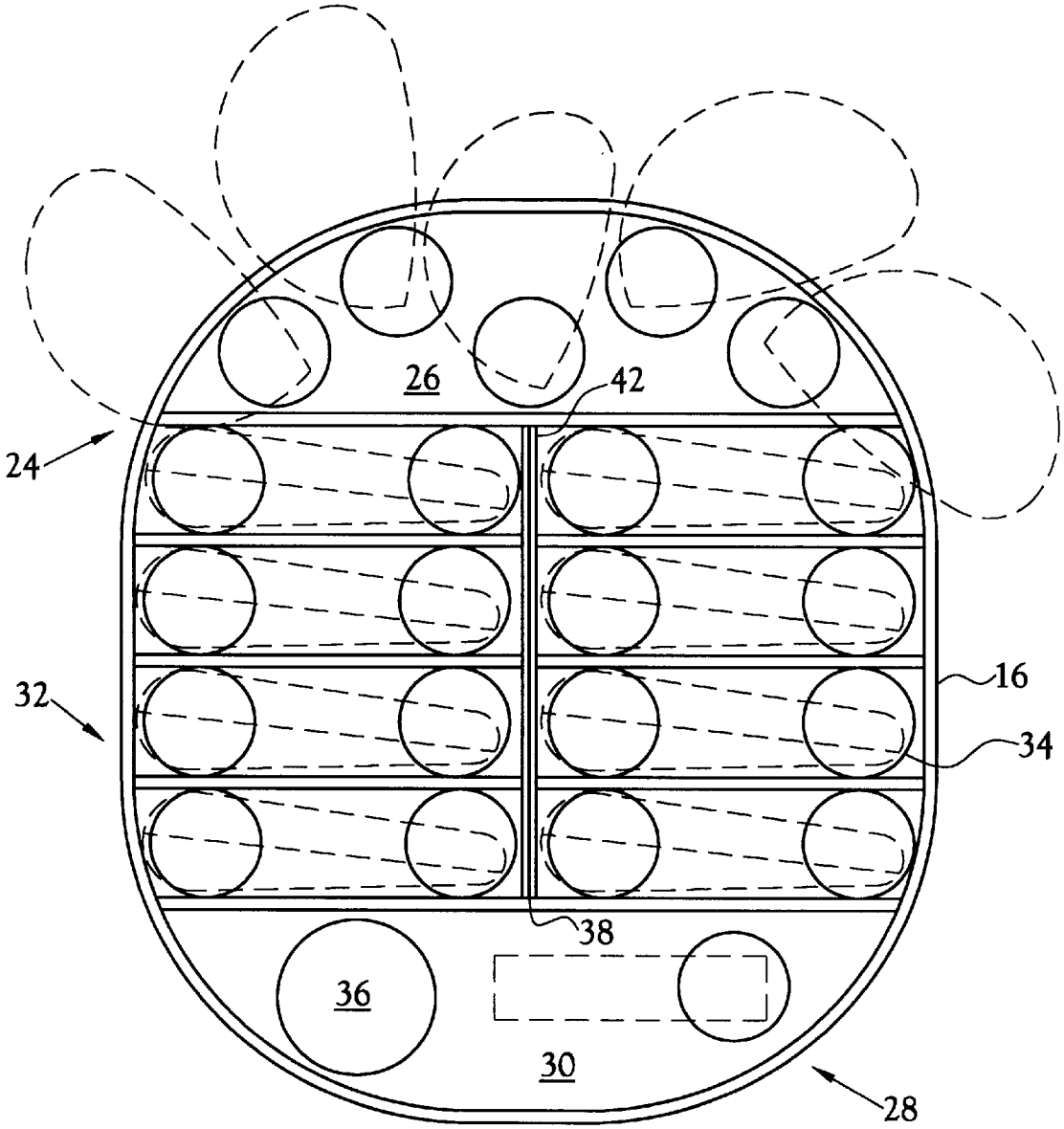
FIG. 2 illustrates the top plan view of the Improved Golf Bag with Club Separator of FIG. 1 further showing individual golf club heads depicted by phantom lines.
Figure 3:
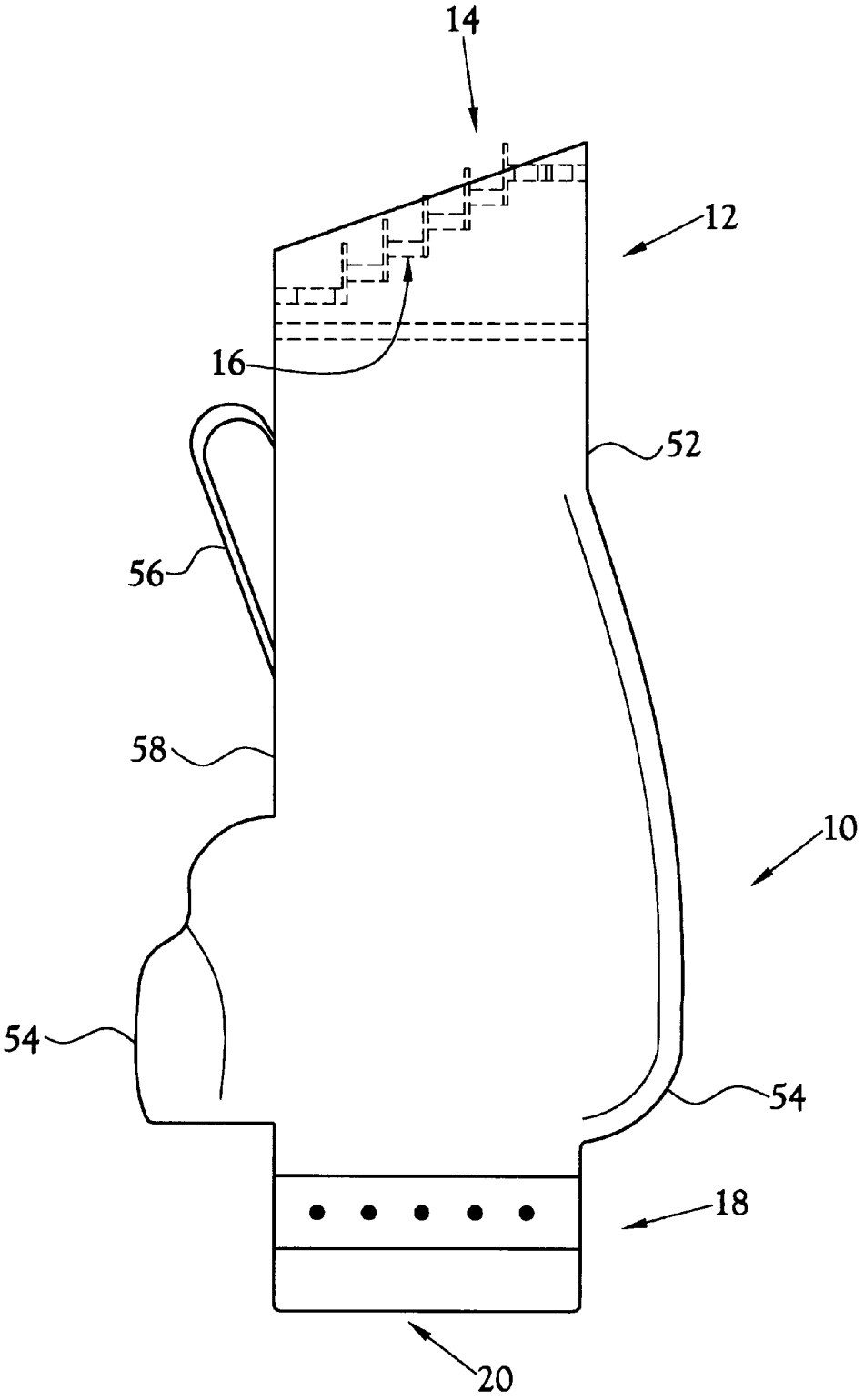
FIG. 3 illustrates an elevation view of the golf bag of the Improved Golf Bag with Club Separator.
Figure 5:
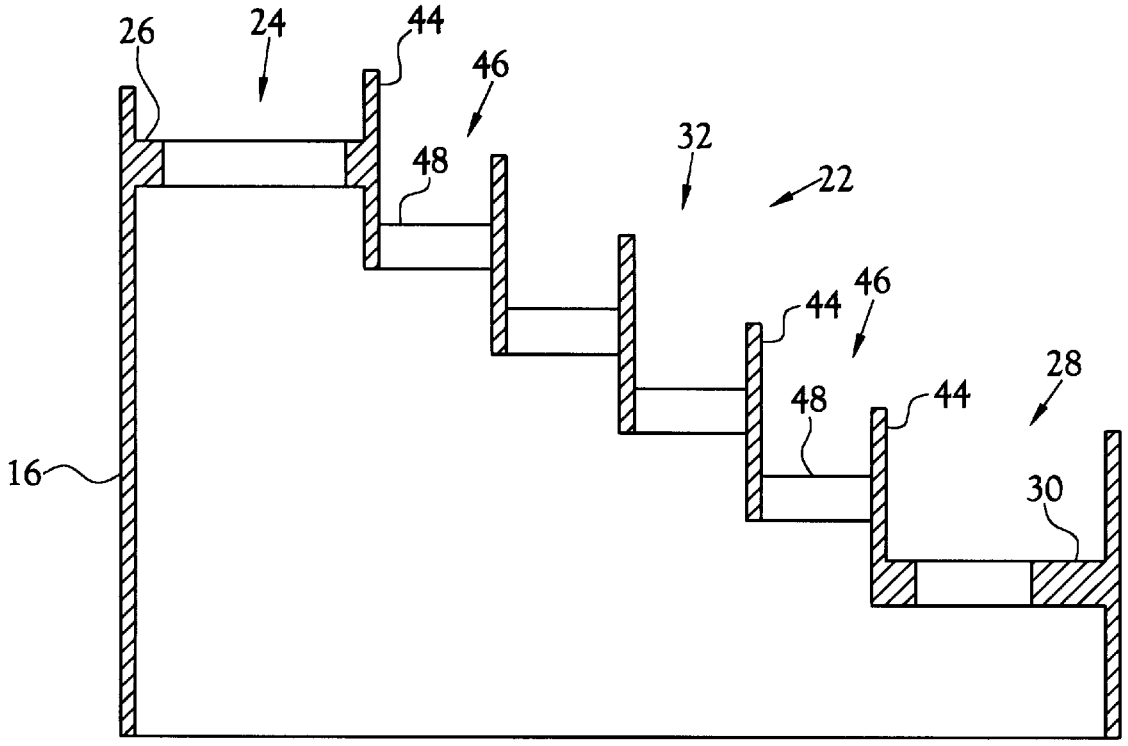
FIG. 5 is an elevation view of, in section, of the Improved Golf Bag with Club Separator taken at 5—5 of FIG. 1.

As illustrated in FIGS. 1 through 3, the club head support 16 defines a plurality of tiers 22. As best illustrated by FIGS. 3 and 5, each tier 22 is staggered from the next in a step-wise fashion such that the first tier 24 defines an uppermost tier 26 and the last tier 28 defines a lowermost tier 30. The plurality of tiers 22 between the uppermost tier 26 and lowermost tier 30 are intermediate tiers 32. The uppermost and lowermost tiers 26, 30 of the club head support 16 include at least one golf club opening 34 for receiving at least one golf club. In the preferred embodiment illustrated by FIGS. 1 and 2, the uppermost tier 26 includes a plurality of golf club openings 34 for receiving a plurality of golf clubs and the lowermost tier 28 contains at least one golf club opening 34 for receiving a golf club and at least one utility opening 36 for receiving a golf utility device. Among the golf utility devices which can be disposed within the utility opening 36 are a golfing umbrella, an extensor device for retrieving golf balls or an auxiliary golf club such as an extra driver or an extra iron. Those skilled in the art will recognize that the utility opening 36 is adaptable for receiving other golf related items as well.

Each of the intermediate tiers 32 of the Improved Golf Bag with Club Separator 10 is divided by a partition 38 disposed between the uppermost and lowermost tiers 26, 30 of the club head support 16. FIGS. 1 and 2 illustrate the preferred embodiment wherein the partition 38 is centrally disposed within each of the intermediate tiers 32 such that each tier 22 is divided in half and individual club head compartments 40 are formed. The wall 42 formed by the partition 38, along with the vertical walls 44 created by adjoining tiers 46 and the horizontal surface 48 separating the adjoining tiers 46 function to create the individual club head compartments 40 for each golf club iron received within at least one opening 34 for receiving a golf club which is positioned on the horizontal surface 48 of each tier 22. As is exemplified in FIGS. 4 and 4*a*, the Improved Golf Bag with Club Separator 10 of the preferred embodiment is fabricated such that, when each golf club is seated in each individual club head compartment 40, the shaft end of the golf club does not touch or contact the lower end 18 of the golf bag 10. In the preferred embodiment illustrated in these figures, each intermediate tier 22 of the Improved Golf Bag with Club Separator 10 includes two oppositely disposed openings 50 which are each capable of receiving a golf club iron. The provision of the two oppositely disposed openings 50 in the preferred embodiment of the Improved Golf Bag with Club Separator 10 facilitates its adaptability for golfing regardless of the handedness of the golfer.

In the preferred embodiment, the Improved Golf Bag with Club Separator includes an exterior surface 52 disposed between the upper and lower ends 12, 18 of the golf bag 10 which is composed of a durable material. As shown in FIGS.

3 and 4, the exterior surface 52 of the Improved Golf Bag with Club Separator 10 of the preferred embodiment includes a plurality of pockets 54 for the carrying and storage of golf-related items and a golf bag handle 56 for carrying the golf bag. Among those golf-related items which can be carried or stored in the plurality of golf bag pockets 54 on the Improved Golf Bag with Club Separator are golf tees, golf balls, golf shoes, protective rain gear, replacement spikes, and golf cards and pencils. Those skilled in the art will recognize that the plurality of golf bag pockets 54 on the Improved Golf Bag with Club Separator 10 of the preferred embodiment are capable of carrying other items as well, including wallets, keys and other related items.

Figure 4:
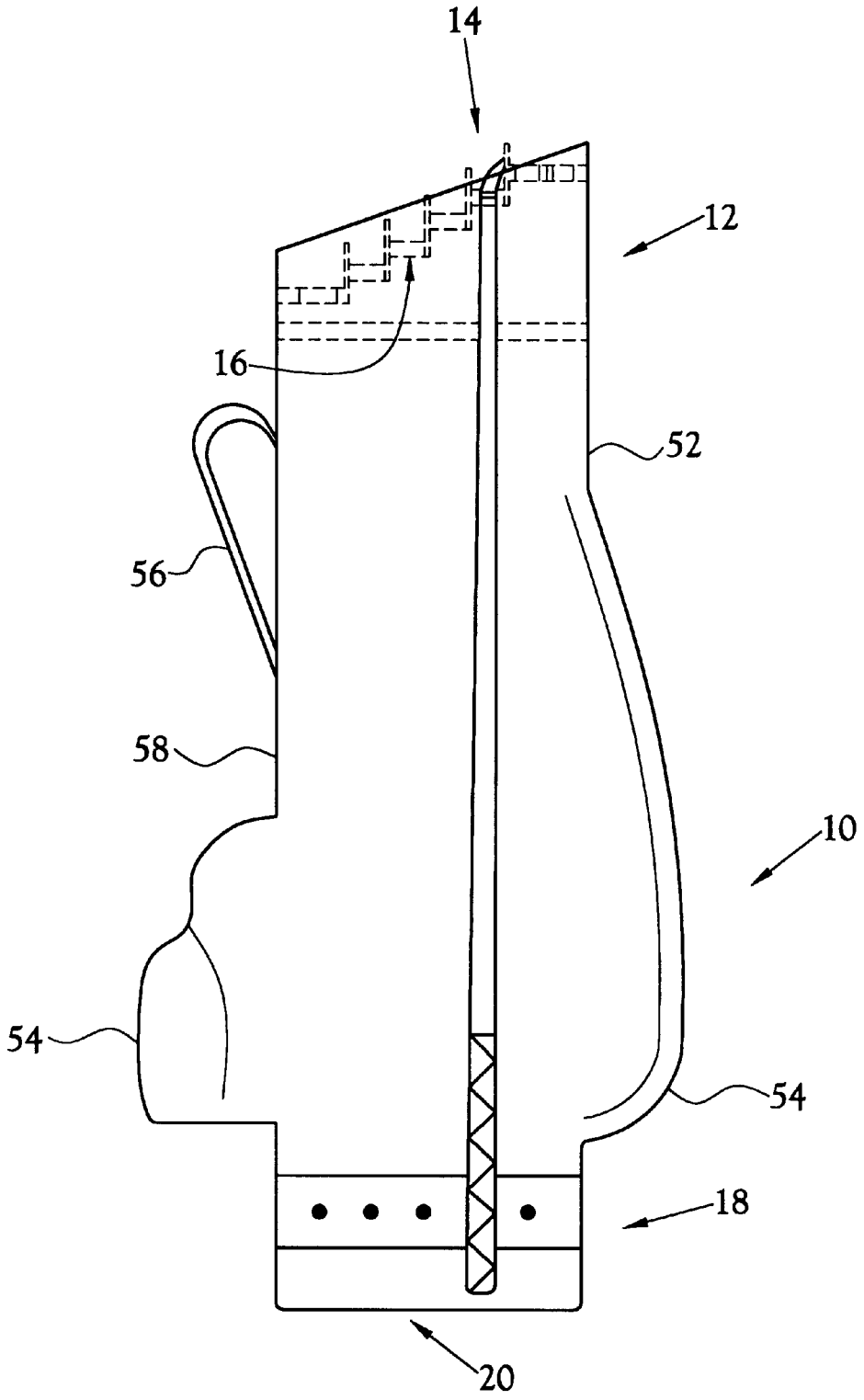
FIG. 4 is an elevation view of the golf bag of the Improved Golf Bag with Club Separator illustrated in FIG. 3 showing a golf club disposed within a golf club opening.
Figure 4A:
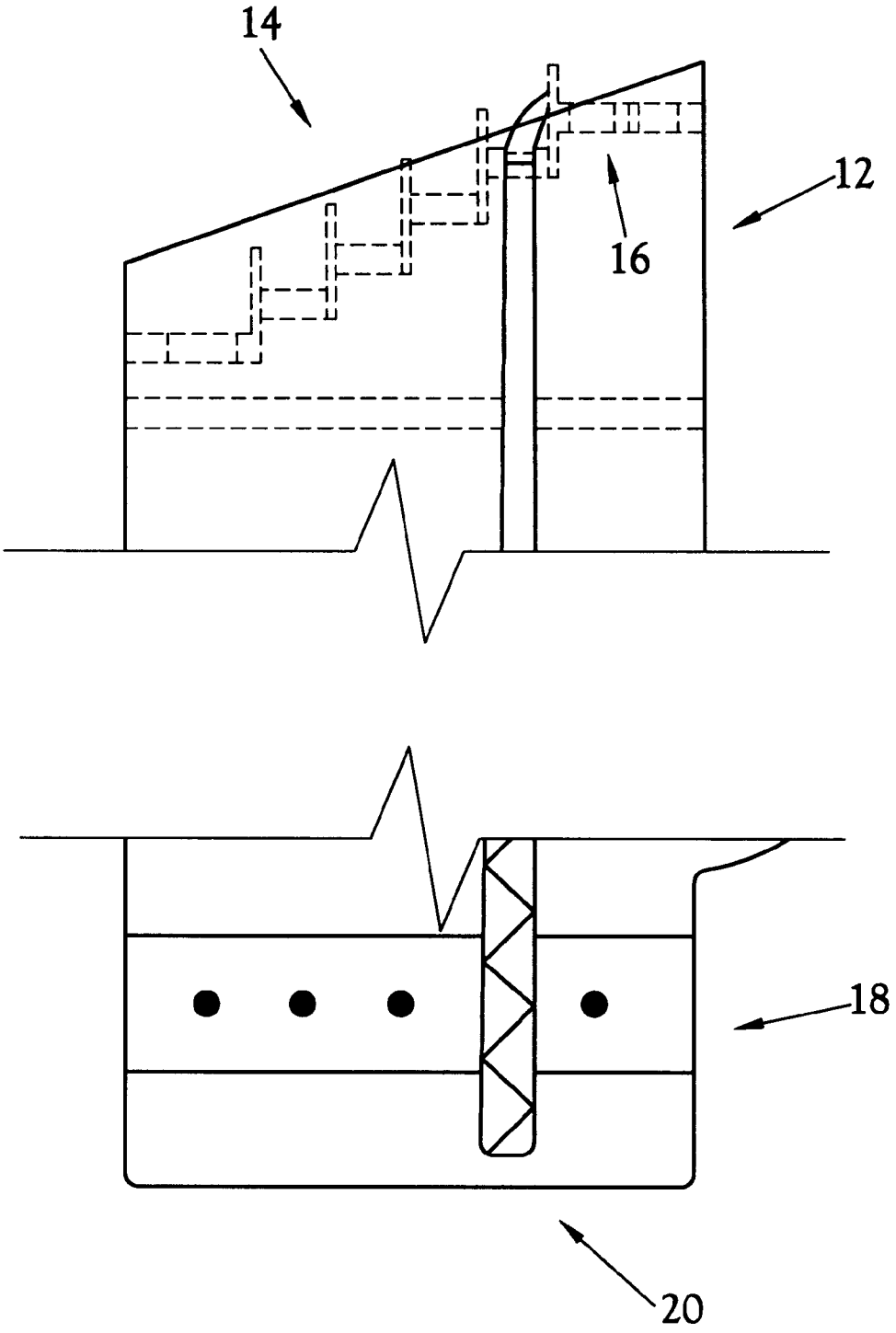
FIG. 4*a* depicts an elevational view of a portion of the Improved Golf Bag with Club Separator shown in FIG. 4.

In the preferred embodiment illustrated by FIGS. 3 and 4, the golf bag handle 56 of the Improved Golf Bag with Club Separator 10 is disposed on a side 58 of the exterior surface 52 opposite the uppermost tier 26 of the club head support 16. In this embodiment, in a conventional golf cart, when the Improved Golf Bag with Club Separator 10 is mounted on the cart, and the securement strap is run through the golf bag handle 56, the irons in the golf bag not only face the back of the cart but are arranged in a cascade fashion to facilitate a golfer's viewing of the clubs as well as their access to them.

Figure 6:
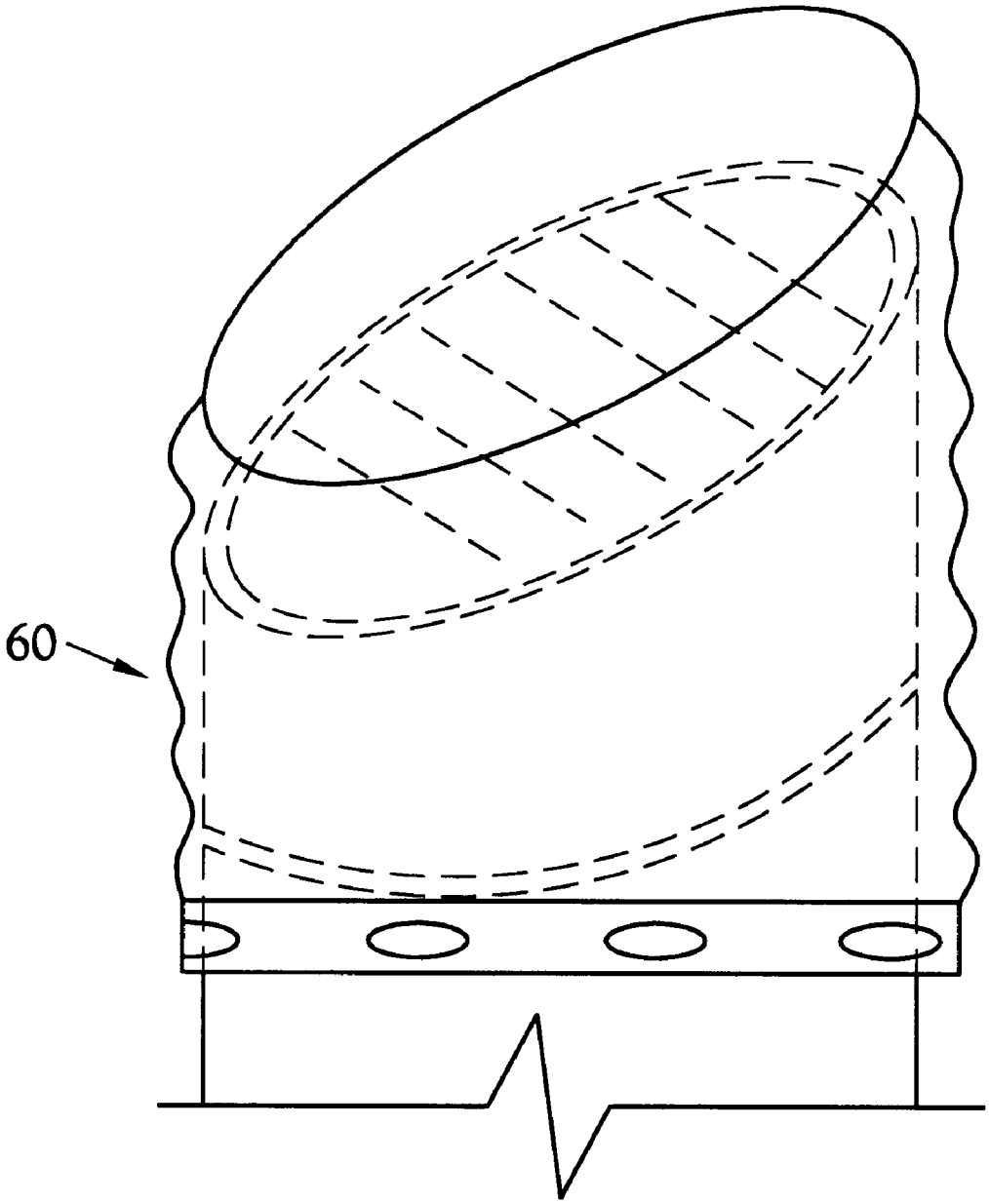
FIG. 6 is a perspective view of the golf club cover of the present invention.
Figure 7:
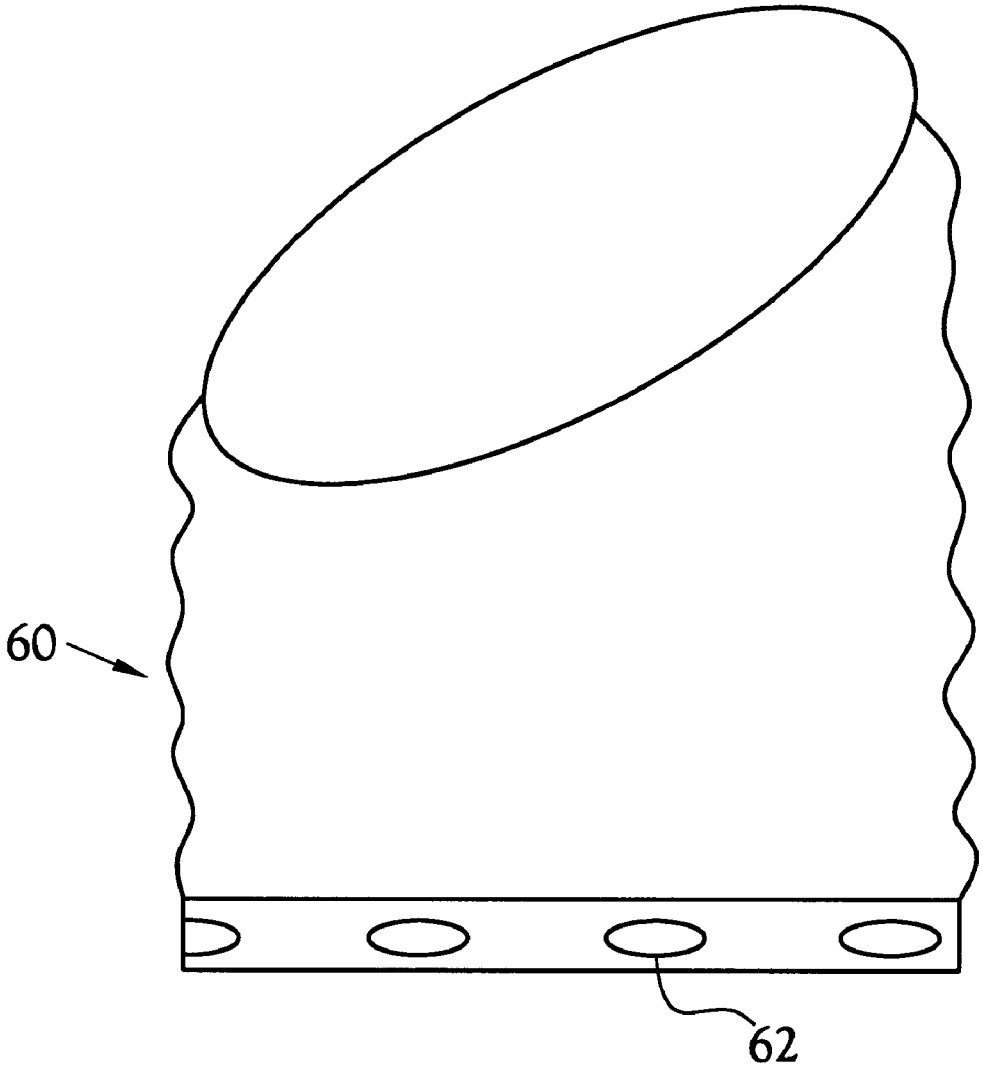
FIG. 7 illustrates a perspective view of the golf club cover of the preferred embodiment.

The Improved Golf Bag with Club Separator 10 of the preferred embodiment further includes a golf club cover 60 which fits on the upper end 12 of the golf bag 10 for protecting the golf clubs in the golf bag 10 from rain and other effects of inclement weather. Those skilled in the art will recognize that the golf club cover 60 of the Improved Golf Bag with Club Separator 10 may be constructed to be attached to or removable from the golf bag 10. They will also recognize that the golf club cover 60 may have a variety of functional configurations to adapt to the varying configurations of a golf bag 10. The golf club cover 60 may also be constructed from various durable materials to selectively form a firm or soft cover to the golf clubs of the golf bag. One example of a soft cover 60, not illustrated, is one which is fabricated from synthetic rubber materials and includes an elastic disposed about its periphery to stretch over the upper end of the golf bag 10 and remain in place based on the contractive nature of the expanded elastic band. In the preferred embodiment illustrated in FIG. 6, the golf club cover 60 is ovoid in shape to adapt to the illustrated embodiment of the Improved Golf Bag with Club Separator 10. As illustrated in FIG. 7, this golf club cover 60 is releasably secured to the golf bag by at least one securement device 62 and is removable upon release of that at least one device 62. Moreover, as also illustrated in this figure, the golf club cover 60 of the preferred embodiment is constructed of flexible, durable materials which form an approximately ovoid-shaped space over the top of the golf clubs to protect them from the elements and from any incidental damage. As illustrated in FIG. 7, the at least one securement device 62 of the preferred embodiment is a plurality of snaps disposed about the golf club cover 60. Those skilled in the art will recognize that other methods of releasable securing of the golf club cover 60 to the Improved Golf Bag with Club Separator 10 golf bag are equally functional. Other adaptable securement devices include VELCRO™ fasteners, releasable hinges, hooks, zippers and other similar arrangements. Other shapes of the golf club 60 cover and other types of materials for fabricating this cover 60 are equally foreseeable.

From the foregoing description, it will be recognized by those skilled in the art that a Improved Golf Bag with Club Separator 10 offering advantages over the prior art has been provided. Specifically, the Improved Golf Bag with Club Separator 10 provides a golf bag with individual club head compartments 40 to secure individual club iron heads in a stable position to minimize or eliminate club head damage due to collision with other club heads. The Improved Golf Bag with Club Separator 10 provides an improved golf bag which recognizes and accounts for the changes in the game today where golfers predominantly use golf carts by providing a club head support in which the irons of the set of golf clubs are always disposed in front when the bag is mounted to a golf cart. The Improved Golf Bag with Club Separator 10 provides an improved golf bag which increases a golfers enjoyment in golfing as the golf bag is more organized and easier to play out of. Moreover Improved Golf Bag with Club Separator 10 is adaptable such that it can be used regardless of a player's handedness.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A golf bag with club separator for carrying golf clubs and protecting club heads of golf club irons from damaging each other, said golf bag with club separator comprising:

an upper end defining an opening;

a club head support received in said opening of said upper end of said golf bag, said club head support defining a plurality of tiers, a first of said tiers being staggered from a last of said tiers in a graduated step-wise fashion, said first tier defining an uppermost tier and said last tier defining a lowermost tier, each of said plurality of said tiers between said uppermost and said lowermost tiers being intermediate tiers, each of said uppermost and said lowermost tiers defining at least one opening for receiving at least one golf club, each of said intermediate tiers being divided by a partition disposed between said uppermost and said lowermost tiers of said club head support, each of said intermediate tiers including a first vertical wall and a second vertical wall spaced apart by a horizontal surface having at least one opening for receiving a golf club iron, said first and said second vertical walls, said partition and said horizontal surface defining a compartment for receiving the club head of the golf club iron, each said compartment being dimensioned to receive the top of the club head laterally with respect to said golf bag on said horizontal surface when the iron is inserted into the bag, said first vertical wall, said second vertical wall, and said partition being disposed between adjacent club heads such that inadvertent rotation of the club heads and damaging engagement therebetween are avoided, each first and second vertical wall extending above the horizontal surface therebetween; and a lower end defining a closure, said closure and being disposed opposite said upper end of said golf bag at a distance whereby the entire length of each golf club iron positioned within said golf bag is received within and supported by said club head support such that each club iron is suspended within said golf bag above said lower end of said golf bag.

2. The golf bag with club separator of claim 1 wherein said partition is centrally disposed in each of said intermediate tiers.

3. The golf bag with club separator of claim 2 wherein said uppermost tier includes a plurality of openings for receiving a plurality of golf clubs.

4. The golf bag with club separator of claim 3 wherein each horizontal surface of each of said intermediate tier compartments includes two oppositely disposed openings, each opening for receiving a golf club.

5. The golf bag with club separator of claim 4 wherein said lowermost tier further includes at least one utility opening for receiving a golfing utility device.

6. The golf bag with club separator of claim 5 wherein said golf bag further includes an exterior surface disposed between said upper end and said lower end of said golf bag, said exterior surface of said golf bag including a golf bag handle for carrying said golf bag, said golf bag handle being disposed on said exterior surface of said golf bag on a side opposite said uppermost tier of said upper club head support such that said golf bag is positionable on and securable to a golf cart by passage of a conventional cart securement strap through an opening defined bv said handle and that each of the heads of the golf clubs in the club separator are readily viewable when said golf bag is mounted on the back of the golf cart.

7. The golf bag with club separator of claim 1 wherein said golf bag further includes a golf bag cover, for being received on said upper end of said golf bag, said golf bag cover for protecting the golf clubs in said golf bag from rain and other effects of inclement weather, said golf bag cover being detachable.

8. A golf bag with club separator for carrying golf clubs and protecting club heads of golf club irons from damaging each other, said golf bag with club separator comprising:

an upper end defining an opening;

a club head support received in said opening of said upper end of said golf bag, said club head support defining a plurality of tiers, a first of said tiers being staggered from a last of said tiers in a graduated step-wise fashion such that said first tier defines an uppermost tier and said last tier defines a lowermost tier, said uppermost tier including a plurality of openings for receiving a plurality of golf clubs, said lowermost tier including an opening for receiving a golf club and a utility opening for receiving a golfing utility device, each of said plurality of said tiers between said uppermost and said lowermost tiers being intermediate tiers, each of said intermediate tiers being divided by a partition disposed between said uppermost and said lowermost tiers of said golf bag, said partition being centrally disposed in each of said intermediate tiers, each intermediate tier further including a first vertical wall and a second vertical wall, said first and second vertical walls being separated by a horizontal surface, said first and said second vertical walls, said horizontal surface and a wall formed by said partition defining a compartment for receiving the club head of the golf club iron, each said compartment being dimensioned to receive the top of the club head laterally with respect to said golf bag on said horizontal surface when the iron is inserted into the bag, said first wall, said second wall, and said partition being disposed between adjacent club heads such that inadvertent rotation of the club heads and damaging engagement therebetween are avoided;

an exterior surface including a golf bag handle for carrying said golf bag, said golf bag handle being disposed on said exterior of said golf bag on a side opposite said uppermost tier of said club head support such that said golf bag is positionable on and securable to a golf cart by passage of a conventional cart securement strap through an opening defined by said handle and that each of the heads of the golf clubs in the club separator are readily viewable when said golf bag is mounted on the back of the golf cart, each first and second vertical wall extending above the horizontal surface therebetween; and a lower end defining a closure, said golf bag exterior surface being disposed between said upper and lower ends of said golf bag, said lower end of said golf bag being disposed opposite said upper end of said golf bag at a distance whereby the entire length of each golf club iron disposed within said golf bag is received in said bag and each head of each club iron is received within and supported by said club head support such that each club iron is suspended within said golf bag above said lower end of said golf bag.

9. A golf bag with club separator for carrying golf clubs and protecting club heads of golf club irons from damaging each other, said golf bag with club separator comprising:

an upper end defining an opening;

a club head support received in said opening of said upper end of said golf bag, said club head support defining a plurality of tiers, a first of said tiers being staggered from a last of said tiers in a graduated step-wise fashion such that said first tier defines an uppermost tier and said last tier defines a lowermost tier, said uppermost tier including a plurality of openings for receiving a plurality of golf clubs, said lowermost tier including an opening for receiving a golf club and a utility opening for receiving a golfing utility device, each of said plurality of said tiers between said uppermost and said lowermost tiers being intermediate tiers, each of said intermediate tiers being divided by a partition disposed between said uppermost and said lowermost tiers of said golf bag, said partition being centrally disposed in each of said intermediate tiers, each intermediate tier further including a first vertical wall and a second vertical wall, said first and second vertical walls being separated by a horizontal surface, said first and said second vertical walls, said; horizontal surface and a wall formed by said partition defining a compartment for receiving the club head of the golf club iron, each said compartment being dimensioned to receive the top of the club head laterally with respect to said golf bag on said horizontal surface when the iron is inserted into the bag, said first wall, said second wall, and said partition being disposed between adjacent club heads such that inadvertent rotation of the club heads and damaging engagement therebetween are avoided;

an exterior surface including and a golf bag handle for carrying said golf bag, said golf bag handle being disposed on said exterior of said golf bag on a side opposite said uppermost tier of said upper club head support such that said golf bag is positionable on and securable to a golf cart by passage of a conventional cart securement strap through an opening defined by said handle and that each of the heads of the golf clubs in the club separator are readily viewable when said golf bag is mounted on the back of the golf cart each first and second vertical wall extending above the horizontal surface therebetween; and a lower end defining a closure, said golf bag exterior surface being disposed between said upper and lower ends of said golf bag, said lower end of said golf bag being disposed opposite said upper end of said golf bag, at a distance whereby the entire length of each golf club iron positioned within said golf bag is received in said bag and each head of each club is received within and supported by said club head support such that each club iron is suspended within said golf bag above said lower end of said golf bag.

* * * * *